United States Patent [19]

Stauber

[11] 4,197,045

[45] Apr. 8, 1980

[54] APPARATUS FOR STACKING PRINTED PRODUCTS

[75] Inventor: Hans-Ulrich Stauber, Grüt, Switzerland

[73] Assignee: Ferag AG, Hinwil, Switzerland

[21] Appl. No.: 908,391

[22] Filed: May 22, 1978

[30] Foreign Application Priority Data

May 31, 1977 [CH] Switzerland ..... 6652/77

[51] Int. Cl.[2] ..... B65G 57/02

[52] U.S. Cl. ..... 414/30; 100/274; 271/220; 414/48; 414/97; 414/907

[58] Field of Search ..... 414/29, 30, 48, 49, 414/97, 907; 271/218, 220, 223, 224; 100/274, 275; 93/93 DP, 93 R

[56] References Cited

U.S. PATENT DOCUMENTS

| | | | |
|---|---|---|---|
| 3,231,100 | 1/1966 | Faber | 414/45 X |
| 3,771,670 | 11/1973 | Napoleone | 414/30 X |

*Primary Examiner*—Stephen G. Kunin
*Assistant Examiner*—George F. Abraham
*Attorney, Agent, or Firm*—Werner W. Kleeman

[57] ABSTRACT

A stacking apparatus for articles, especially printed products, comprising a stacking chute or channel which can be loaded from its top end with the printed products and at least one pair of press or contact elements which can be driven to-and-fro in the lengthwise direction of the stack chute and arranged at one side thereof. These press or contact elements periodically engage into the confines of the stack chute, in order to exert a pressure force upon the momentarily uppermost located printed product of the printed product stack. To obtain an uninterrupted action of the pressure or contact force, the press elements, which preferably have the shape of pawls, are arranged almost above one another. The one press element of the pair is driven in counter cycle, i.e., out-of-phase in relation to the other press element.

8 Claims, 6 Drawing Figures

APPARATUS FOR STACKING PRINTED PRODUCTS

BACKGROUND OF THE INVENTION

The present invention broadly relates to material handling apparatus, and more particularly to a new and improved construction of apparatus for stacking products, especially printed products, and in particular folded printed products.

The stacker apparatus of the present invention is of the type comprising a stacker chute or channel which can be loaded with the printed products from its top end or upper region and at least one pair of press or contact elements arranged at one side of the stack or stacker chute. This pair of press or contact elements can be driven to move to-and-fro in the lengthwise direction of the stack chute and periodically engages into such stack chute, in order to thus press against the momentarily uppermost located printed product of the stack.

One such type of apparatus has been disclosed, for instance, in U.S. Pat. No. 3,231,100, granted Jan. 25, 1966, entitled "Automatic Jogger Mechanism", especially in FIGS. 7 and 8 of such patent. With this prior art apparatus, the press or contact elements, arranged adjacent one another and constructed approximately in the form of an angle element, are synchronouly driven by a crank drive in such a manner that the free ends of one leg of each angle element describes an essentially oval path. Further, during the course of the downward stroke the free end of each such leg of the angle elements engages into the stack chute or channel, and thus, exerts a pressure force upon the edge of the uppermost situated printed product. At the end of the downward stroke, the free ends of such angle elements however depart from the stack chute, in order to carry out an upward movement or stroke externally of such stack chute. This means, however, that with the state-of-the-art apparatus also the pressure or contact action, exerted upon the stack which is in the process of being formed, is periodically interrupted. Particularly when processing stacks formed of comparatively thick, folded printed products such interruption of the pressure force is disadvantageous, because such type stack, especially when reaching a certain height, tends to behave to a certain extent like a spring which elongates as soon as the pressure force is no longer exerted. Such return spring action, with the prior art equipment, if it is charged with folded printed products, can lead to the undesirable result that the entire elevational stroke of the press or contact elements is not sufficient to compensate for the return spring action which arises during the periodic interruption of the pressure or contact force.

By way of completeness, it is here further mentioned that also other apparatuses are known to the art—which only to a certain extent can be compared with the present invention—, wherein there is exerted a pressure force upon the growing stack. Thus, for instance, with the equipment disclosed in either French Pat. No. 2,043,587 or German Pat. No. 1,189,087 there are provided rotating roll brushes which, according to the aforementioned German Pat. 1,189,087, engage at one upper side edge or edge of the printed products, or as disclosed in the aforementioned French Pat. No. 2,043,587, engaged at two oppositely situated upper side edges or edges, and thus, exert a downwardly effective force, without hindering the further loading or charging or the stack. However, the action of these brushes is that the side edges of the printed products, where they engage, are exposed to an erasing or scraping action, so that the danger exists that these edges of the printed products will be damaged, or, in the case of a folded printed product, that the print will be smudged.

According to a further prior art construction as disclosed in French Pat. No. 2,223,287, the stack is charged from below and the top side of the stack is weighted by means of a set of rolls.

Furthermore, holddown constructions which periodically engage at the edge of the uppermost copy or product of the stack, and thus exert a pressure force thereat, are for instance known from French Pat. No. 287,205 and German Pat. No. 1,122,553. Also here, however, the pressure force exerted upon the stack experiences a periodic interruption, resulting in all of the drawbacks which have already been described above in conjunction with the equipment disclosed in the previously mentioned U.S. Pat. No. 3,231,100.

SUMMARY OF THE INVENTION

Hence, with the foregoing in mind, it is a primary object of the present invention to provide an improved apparatus for stacking articles, especially printed products, in a manner not associated with the aforementioned drawbacks and limitations of the prior art proposals.

Another and more specific object of the present invention aims at the provision of an apparatus of the previously mentioned type, wherein, notwithstanding the periodicity with which the press or contact elements engage into the stack chute or channel, the stack of products is exposed without any interruption to the pressure or contact force.

Yet a further significant object of the present invention is to provide a new and improved construction of stacker apparatus for printed products wherein there is continually exerted a pressure or contact force upon the stacked printed products, to thus prevent the undesirable return spring action thereof as above explained, and to enhance the stack formation and the handling of the printed products.

Another noteworthy object of the present invention aims at the provision of a new and improved construction of apparatus for stacking articles, especially printed products, in particular folded printed products, which is relatively simple in construction and design, quite economical to manufacture, extremely reliable in operation, not readily subject to breakdown, or malfunction, requires a minimum of maintenance and servicing, and affords reliable formation of the printed product stack while continuously exerting a contact or pressure force thereon to prevent any undesired expansion of the compressed together stack.

Now, in order to implement these and still further objects of the invention, which will become more readily apparent as the description proceeds, the stacking apparatus of the present development is manifested by the features that the press or contact elements of each pair are arranged practically above one another, i.e., almost over one another, and further, the one press or contact element of each pair is driven so as to operate counter cycle, i.e., out-of-phase with regard to the other press element of such pair.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
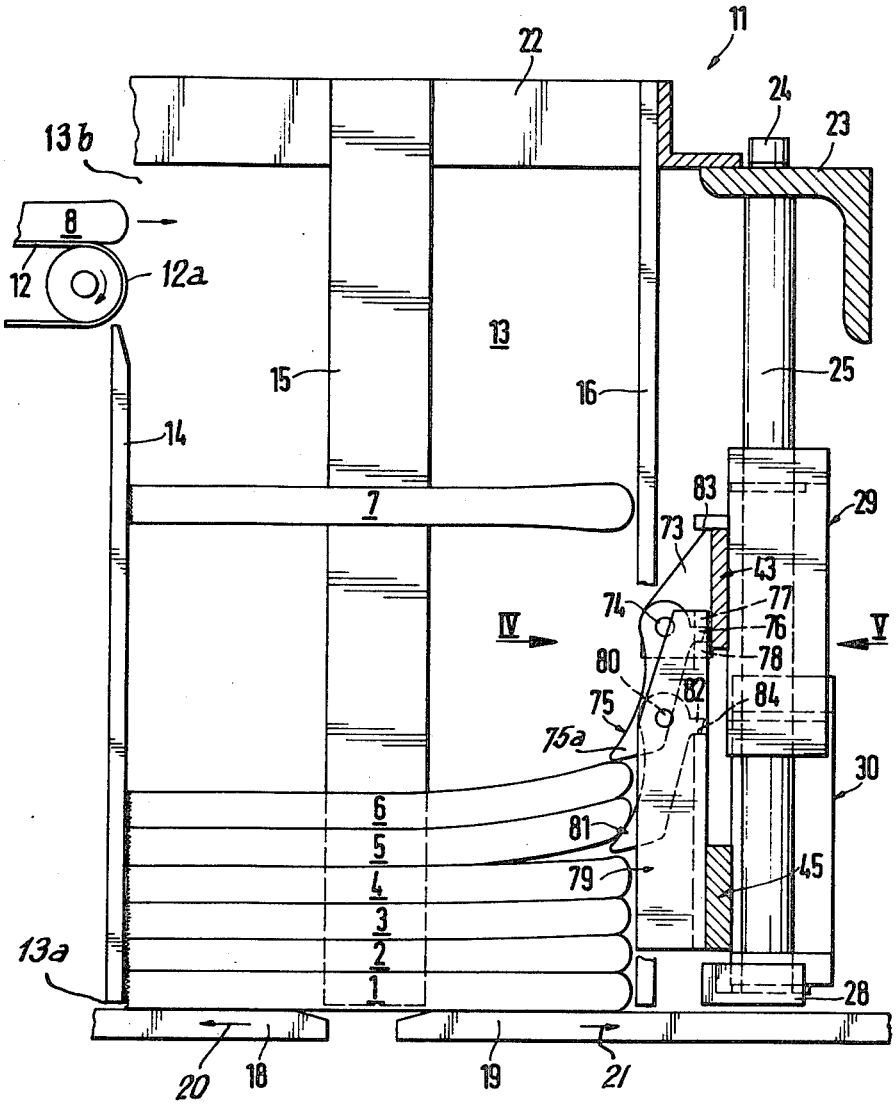
FIG. 1 is a simplified side view of a proposed construction of stacker apparatus according to the invention showing one of the operating phases.

Describing now the drawings, the stacking or stacker apparatus 11 shown in FIGS. 1–6, will be seen to comprise a stacking or stacker chute or channel 13 arranged at the outfeed end 12*a* of any suitable product infeed device, here merely schematically shown as a conveyor belt or band 12. The stacker chute or channel 13 is bounded at its four sides by upstanding, spacedly arranged contact ledges or rails 14, 15, 16 and 17, as best seen by referring to FIG. 6. The floor or base 13*a* of the stacker chute 13, remote from the upper end or top 13*b* where there are infed the products or articles being handled, is formed by two slide plates 18 and 19 which can be shifted away from one another by any suitable means, in the direction of the arrows 20 and 21, respectively, in order to thereby downwardly free the product stack formed within the stacker or stacking chute 13. The contact ledges or rails 15, 16 and 17 are fixed in any suitable manner so as to suspend downwardly from a frame or support 22. Attached essentially in parallelism to the plane defined by the contact rails 16 at the frame 22 is a transverse support 23. At this transverse support 23 there are secured by any suitable means, such as the here illustrated bolts 24 or equivalent fastening devices, two vertical guide rods 25 and 26 which are arranged in spaced relationship from one another and so as to depend from the transverse support or carrier 23. At the lower ends of the guide rods 25 and 26, as best seen by referring to FIG. 5, there is fixedly screwed a profile or structured element or member 28 by means of, for instance, the shown screws 27. This profile element 28 not only interconnects the guide rods 25 and 26, but also, as will be demonstrated from the disclosure to follow, constitutes a lower stop means or impact element for the parts or components guided by the guide rods 25 and 26.

Figure 5:
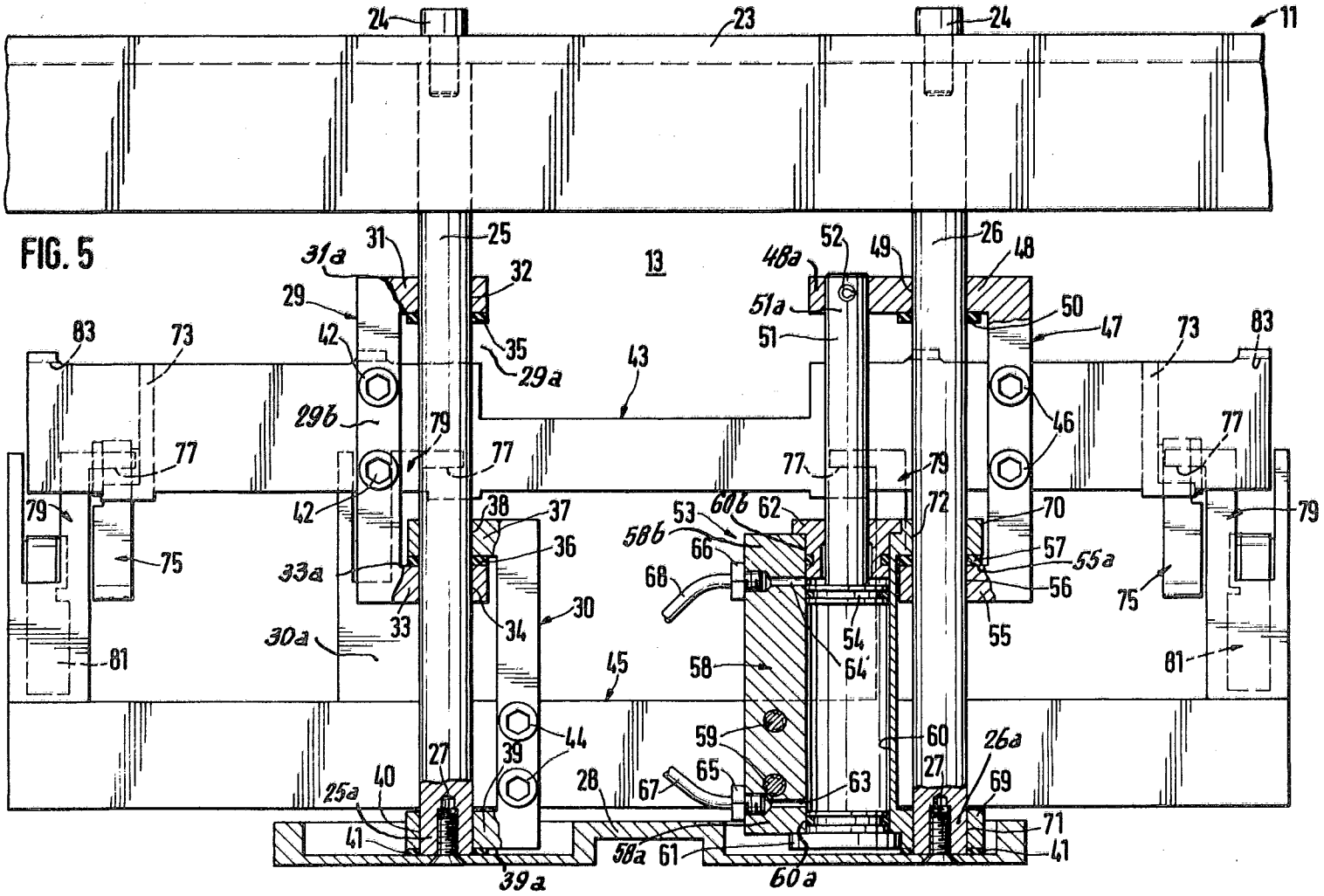
FIG. 5 is a fragmentary view, partially in section in a vertical plane, of the stacker apparatus of FIG. 1, looking in the direction of the arrow V thereof.
Figure 6:
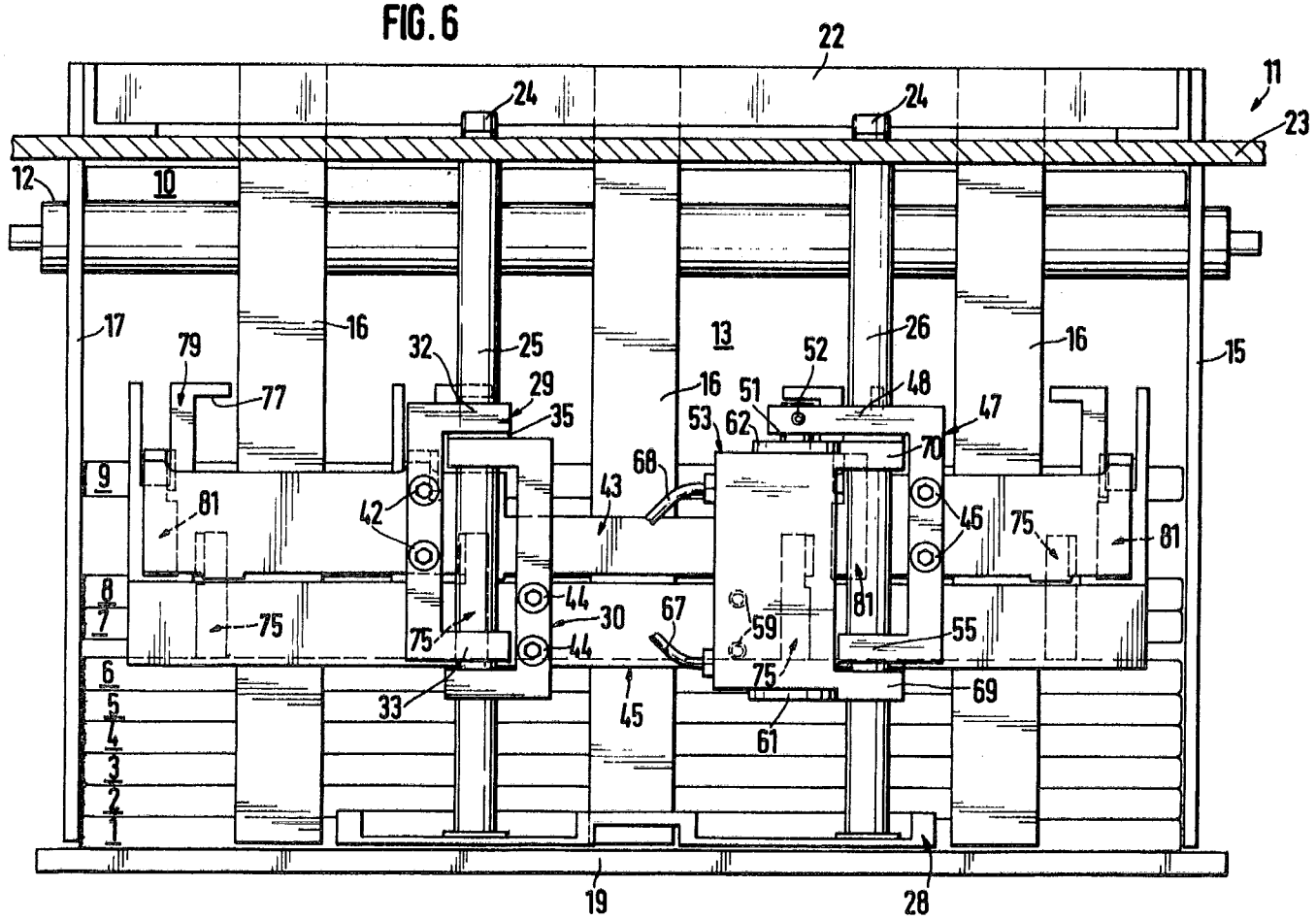
FIG. 6 is a cross-sectional view of the stacker apparatus shown in FIG. 3, taken substantially along the line VI—VI thereof.

Now, as best seen by referring to FIGS. 5 and 6, there are provided for the guide rod 25 two bracket-shaped or C-shaped slide elements or slides 29 and 30. The arrangement is accomplished such that the open sides 29*a* and 30*a* of both of such slides of slide elements 29 and 30, respectively, confront one another as shown, and that in each case one of the legs of one slide element engages between the legs of the other slide element. In particular, the partially sectionally shown leg 31 of the slide element 29 has a bore 32 through which there piercingly extends the guide rod 25. Equally, the leg 33 of such slide element 29 has a bore 39 through which likewise piercingly extends the guide rod 25. At the mutually confronting sides or faces 31*a* and 33*a* of both legs 31 and 33, respectively, there are attached the substantially ring-shaped shock absorbers or cushions 35 and 36, respectively, for instance, formed of rubber, which surround the related bores 32 and 34 respectively. The other slide element 30 is similarly mounted. Its leg 37 which engages between the legs 31 and 33 of the slide element 29 will be seen to have a bore 38 and its other leg 39 likewise has a bore 40. Through the bores 38 and 40 there piercingly extends the guide rod 25. At the side 39*a* of the leg 30 which confronts the profile element 29 there is provided a substantially ring-shaped shock absorber or cushion 41 which surrounds the bore 40.

At the intermediate region 29*b* of the slide element 29 there is attached thereto by means of any suitable fixing devices, such as the bolts 42 a traverse or crosstie member 43 which extends practically over the entire width of the stack chute or channel 13 as best seen by referring to FIG. 6. Near to the leg 39 there is attached at the slide element 30, by means of bolts 44 or equivalent fixing devices, a further traverse or crosstie member or element 45, likewise extending practically over the entire width of the stacker or stacking chute 13.

By means of the bolts 46 or equivalent fixing device there is secured to the traverse or crosstie element 43 a sliding element or slide 47 which is similar to the sliding element 29, however arranged in mirror-image fashion. The upper leg 48 of the sliding element 47 is provided with a bore 49 for receiving the related guide rod 26 and with a cushion or shock absorber 50, as shown. Further, this upper leg 48 is extended so as to protrude past the bore 49. At this extended or prolonged section 48*a* of the leg 48 there is anchored, for instance by means of a fixing pin 52, the free end 51*a* of a piston rod 51. The piston rod 51 has a piston 54 which is part of a double-acting fluid drive unit 53, i.e., a fluid operated piston-and-cylinder arrangement, as will be explained more fully hereinafter. The lower leg 55 of the sliding element 47 will be seen to comprise a bore 56 which receives the guide rod 26 and at its side or face 55*a* confronting the upper leg 48 is provided with a shock absorber or cushion 57 or equivalent structure.

Now the cylinder body or cylinder 58 of the fluid drive unit 53 is attached by bolts 59 or equivalent fixing means with the traverse 45 and possesses a cylinder bore 60 in which there is displacedly mounted the piston 54. The cylinder bore 60 is sealed at one end 60*a* by a stopper or threaded plug 61 and at its other end 60*b* by means of an annular guide sleeve or guide 62 through which piercingly extends the piston rod 51. At the region of the stopper or plug 61 and the guide sleeve 62 there open into the cylinder bore 60 the ports or passages 63 and 64, respectively. Connected in flow communication with these ports or passages 63 and 64 are nipples 65 and 66 and with these nipples the flexible hose lines or conduits 67 and 68 respectively, these hose lines 67 and 68 being alternately and in counter cycle connectible with a not particularly illustrated but any suitable source of pressurized fluid medium and the atmosphere, respectively. This will again be discussed more fully hereinafter.

Now at both opposed ends 58*a* and 58*b* of the cylinder body or cylinder 58 there are formed or otherwise provided thereat laterally protruding overhang members or cantilevers 69 and 70, respectively. At these overhang members or cantilevers 69 and 70 there are provided the respective bores 71 and 72 for the reception of the related guide rod 26. The overhang member 70 extends between the legs 48 and 55 of the slide element or slide 47, as best seen by referring to FIG. 5. The cylinder body or cylinder 58 is thus comparable to the slide element 30, with the difference however, that there is integrated therein the cylinder bore or chamber 60.

Figure 2:
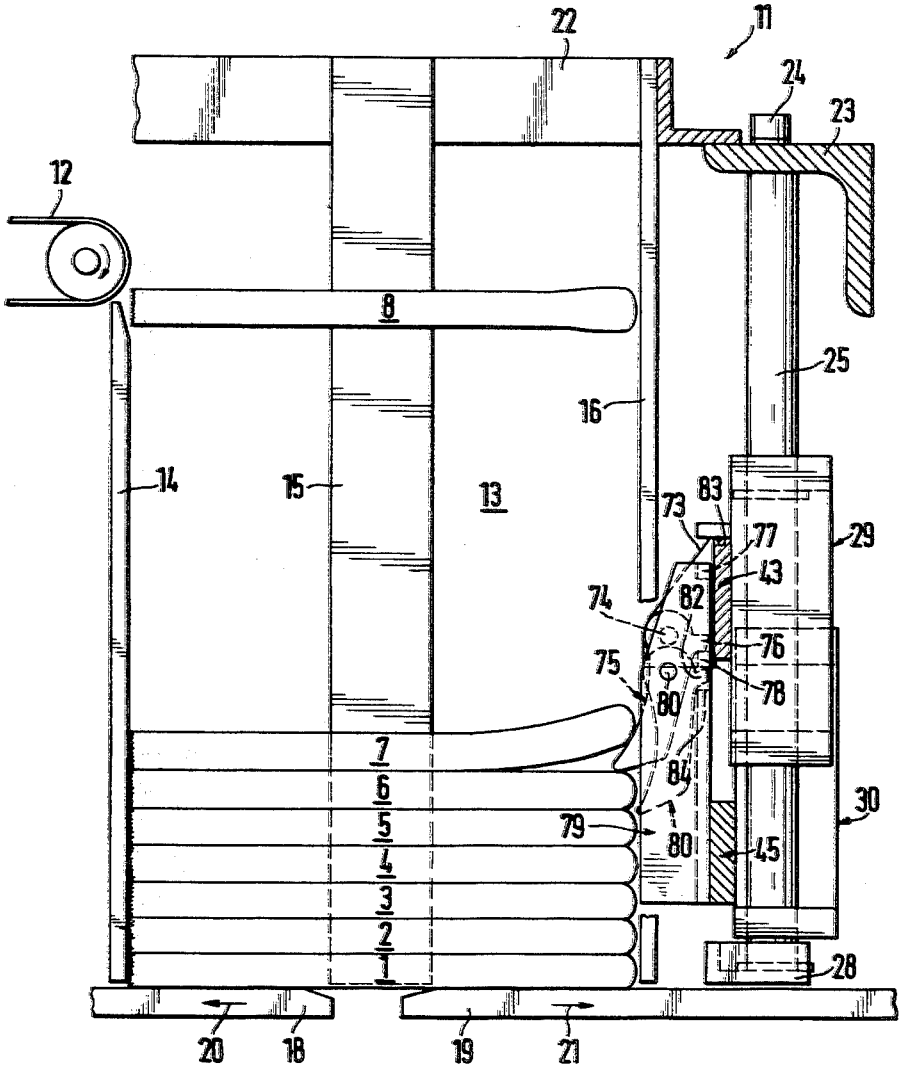
FIG. 2 is a side view of the stacker apparatus shown in FIG. 1, showing another successive operating phase.
Figure 3:
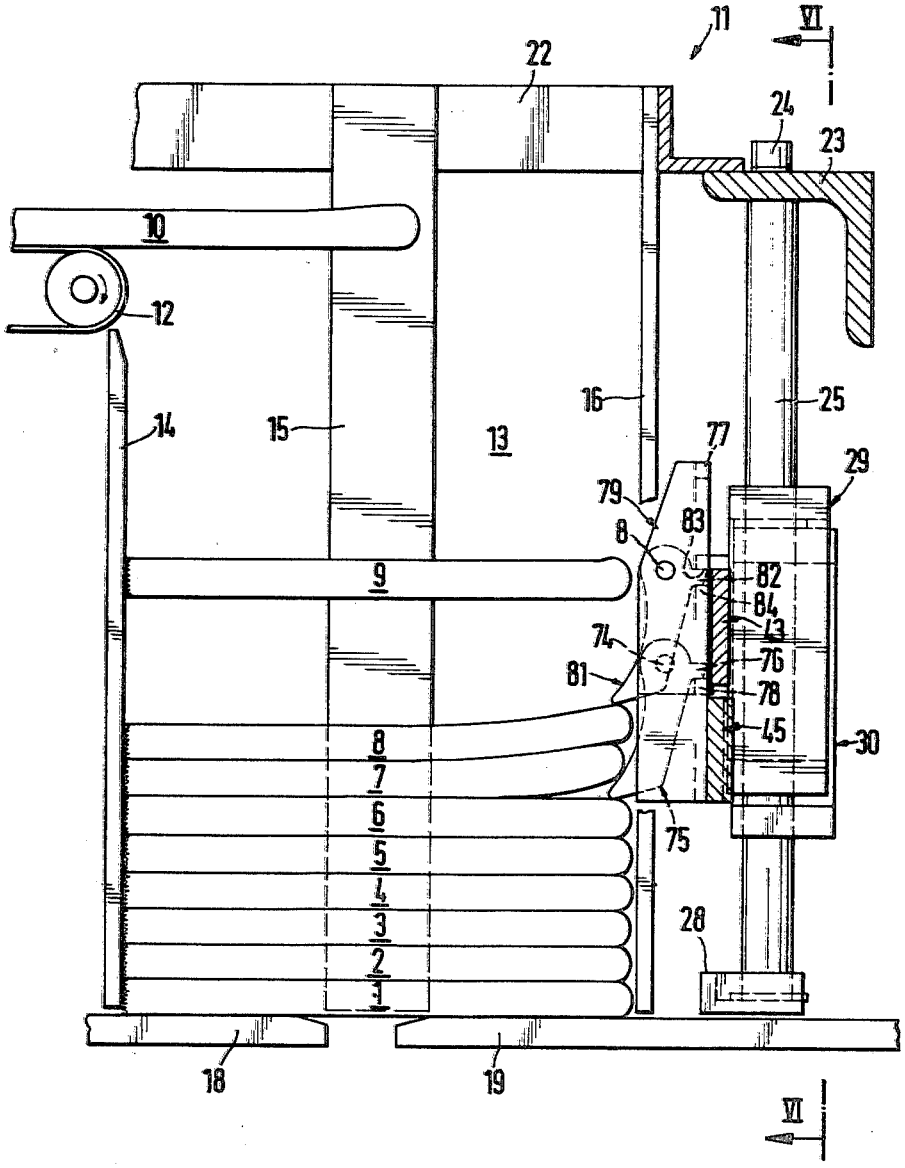
FIG. 3 is a side view of the stacker apparatus shown in FIG. 1, showing still another successive operating phase.

Continuing, in FIGS. 1–3 there will be recognized the guide rod 25 and the slide elements 29 and 30 which are displacedly guided thereat, and also, in sectional view, the traverse or crosstie members 43 and 45. The other guide rod 26 as well as the slide or sliding element 47 and the cylinder body or cylinder 58 are not visible in the showing of FIGS. 1–3, partially for the reason that the same are covered by the shown components and, furthermore, have been conveniently omitted to simplify the illustration and to improve clarity in detail.

Now as best seen by referring to FIGS. 1–4, substantially triangular-shaped brackets or straps 73 are secured at the traverse 43 and at an essentially uniform spacing from one another. At each such bracket 73 there is hingedly connected by means of a pivot pin 74 or equivalent structure a respective press or contact element 75 which normally protrudes into the stacker chute or channel 13. The free end of each such press or contact element 75, shown for instance of finger-like configuration, possesses the shape of a pawl tooth 75*a* which protrudes in the direction of the bottom or base 13*a* of the stacker chute 13, and enables the printed products or the like which arrive in such stacker chute 13 to pass such press or contact element 75. In FIG. 1, the already stacked printed products have been designated by reference characters 1–6, the printed product which is in free fall within the stacker chute 13 has been designated by reference character 7 and the printed product which is still moving on the conveyor belt 12 into the stacker chute 13 has been designated by reference character 8. At the region of each pivot pin 74 there is formed at the related press or contact element 75 a contact or stop nose 76 coacting with counter stops or impact members 77 and 78. Each counter stop 77 is formed or secured, as desired, at a bracket 79 upwardly protruding from the related traverse or crosstie member 45, whereas the counter stop 78 is attached or formed, again as desired, at the related traverse or crosstie member 43. Hingedly connected at each of the brackets 79, by means of a pivot pin 80, is a press or contact element 81 which is structured similar to the press or contact element 75. At these press or contact elements 81 there is likewise formed or provided a contact or impact nose 82 which coacts with the counter stops 83 and 84. The counter stops 83 are attached or formed, as desired, at the traverse or crosstie member 43, whereas the counter stops 84 are formed at the traverse or crosstie member 45.

The lower counter stops 78 and 84 limit the pivotal range in the clockwise direction of the related press or contact elements 75 and 81, respectively, i.e., determine the degree of protruding of the free end or press edges of these press elements 75 and 81 into the stacker chute 13, but however, do not hinder these press or contact elements from being pushed out of the stacker chute. The upper counter stops 77 and 83, on the other hand, force the related press or contact elements 75 and 81, respectively, into their so-called "extended position", where they protrude into the stacker chute 13, as soon as their stop noses 76 and 82, respectively, impacts against such counter stops 77 and 83, respectively.

From what has been explained above, and particularly from the showing of FIG. 6, it will be appreciated that there are provided, for instance, four pairs of press or contact elements 75 and 81, wherein the one press element, such as the element 75 of each pair, is articulated at the related traverse or crosstie member 43, and therefore, is movable along therewith, whereas the other press element, such as the press or contact element 81 of each pair, is articulated at the other traverse or crosstie member 45, and thus, equally movable along therewith, and both traverses or crosstie members 43 and 45 are freely displacably guided in the lengthwise direction of the stacker chute 13 and the guide rods 25 and 26.

Figure 4:
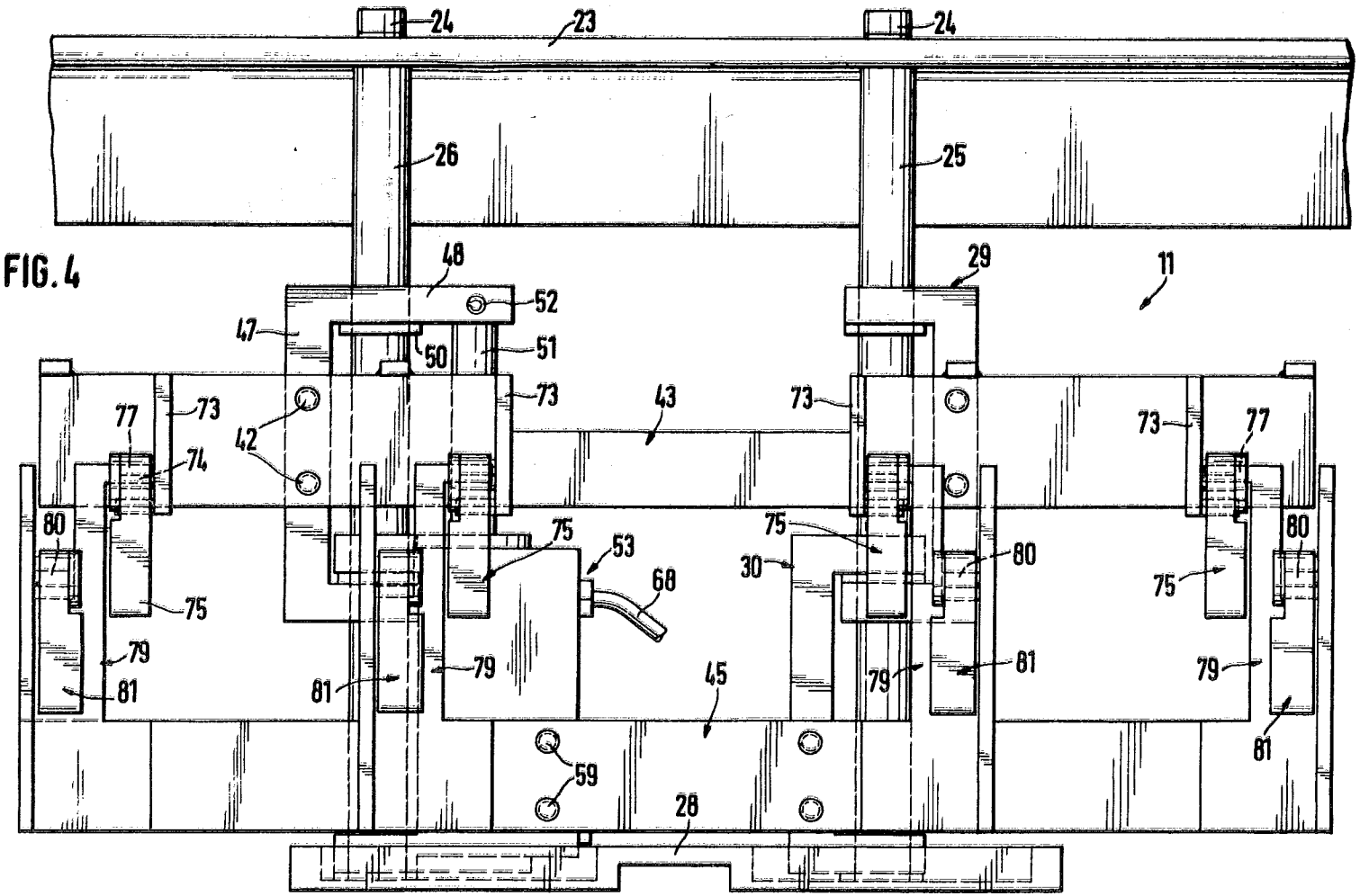
FIG. 4 is a partial fragmentary sectional view of the stacker apparatus shown in FIG. 1, looking in the direction of the arrow IV thereof.

By virtue of the already referred to alternate pressure loading or impingement with the pressurized fluid medium of the piston 54 and the cylinder bore 60 the traverses 43 and 45 are periodically moved away from one another and towards one another. In the showing of FIGS. 1, 4 and 5, the traverse 45 is in its lowermost position, since the associated guide elements, namely the slide element 30 and the cylinder body or cylinder 58 and the cushions or shock absorbers 41 bear against the profile element 28. At the same time the traverse or crosstie member 43 is located in its position most remote from the traverse 45. In this position each press or contact element 81, since it only bears with its contact or stop nose 82 at the counter stop 84, can be pushed out of the stacker chute 13.

It is now assumed that during the stacking operation the piston 54 is pressure impinged from the side of the piston rod 51 with the pressure of the suitably employed pressurized fluid medium, whereas cylinder bore 60 is vented at the other side or face of the piston 54. The traverses or crosstie members 43 and 45 are thus forced to approach one another. Initially, the traverse 43, as best seen by referring to FIG. 2, will drop or lower somewhat, and the press or contact element 75 will bear at the closest situated fold of the printed product 6. Due to the inherent weight of the parts which are displacable at the guide rods 25 and 26 it is therefore possible to press together in a forceful manner the folds of the printed products. The degree of compaction or pressing together of the folds and the extent through which the traverse or crosstie member 43 can lower in position, of course is limited, so that any further approach of the traverses 43 and 45 only then can be accomplished in that the traverse 45 is raised. This has been shown in FIGS. 2 and 3, wherein in FIG. 3, as well as in FIG. 6, the traverses or crosstie members 43 and 45 have been shown in their mutual closest position. During the course of raising of the traverse or crosstie member 45 the press or contact elements 75 are so-to-speak "overtaken" by the press or contact elements 81 so that now each of the free ends of the press or contact elements 81 protrude above the press or contact elements 75 into the stacker chute 13. Now, if there is reversed the pressure impingement of the piston 54 by means of the pressurized fluid medium-drive unit 53, then initially the traverse 45 together with the press or contact elements 81 lowers to such an extent as is possible, while exerting a pressure or contact action at the fold of the printed products 7 and 8 which in the meantime have been infed to the stack, whereafter the traverse 43 is again raised until the relative position of the traverse or crosstie members 43 and 45 with respect to one another has again assumed the position shown essentially in FIGS. 1, 4 and 5.

The parts or components guided by the guide rods 25 and 26 thus will be seen to "climb" stepwise at the growing stack and, therefore, alternately bear by means of the press or contact elements 75 and 81 at such one upper edge, with the beneficial result that the folds of the printed products are forcefully pressed together or compressed without any interruption in the pressing or contact force, and thus, there is insured for a nice squared, stable stack configuration.

Now, when the finished formed stack is released out of the stacker apparatus by opening the slide plates 18 and 19, then the press or contact elements 75 and 81, together with the inherent weight of the parts displacably guided at the guide rods 25 and 26 augment the ejection of the finished stack and, at the same time, shift back into their lowermost position where the slide element 30 and the cylinder body or cylinder 58 bears against the profile element 28. During the ejection of the stack out of the stacker chute 13 it is unnecessary to interrupt the alternate pressure loading or impingement of the fluid drive unit 53.

It should be understood that the number of press or contact elements which are arranged along the traverses 43 and 45 essentially depends upon the nature and shape of the stacked printed products or articles which are being handled. Equally, it should be self-evident that, if necessary, there can be provided press or contact elements at more than one side of the stacker chute 13, and such can be arranged to be shiftable to-and-fro independently of one another at such respective sides, or also can be movable synchronously to-and-fro at all sides. For this purpose the traverses or crosstie members 43 and 45 could be configured in the shape of a substantially U-shaped bracket and arranged in such a fashion that the legs of the traverses also externally engage over the sides formed by the stop ledges 15 and 17 of the stacker chute 13. At these flexed legs of the traverses there also could be similarly arranged press or contact elements. This would produce a pressing action at three upper edges of the stack.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for stacking products, especially printed products, and in particular folded printed products, comprising:

means defining a stacker chute for the products, such stacker chute being structured to be loadable from an upper region thereof with the products to be stacked;

at least one pair of press elements arranged at one side of the stacker chute;

means for driving said press elements to-and-fro in the lengthwise direction of the stacker chute and for periodically engaging into the confines of the stacker chute, in order to press against the uppermost product of the product stack;

means mounting said press elements of each pair so as to be almost arranged above one another; and said means for driving including a mechanism for driving one of the press elements of the pair in a counter cycle to the other press element of the pair.

2. The apparatus as defined in claim 1, wherein:

said driving means drives the press elements such that the displacement strokes thereof mutually overlap one another.

3. The apparatus as defined in claim 1, wherein:

each of said press elements possesses the shape of a pawl structured so as to be displaceable out of the stacker chute during the course of lifting of such pawls.

4. The apparatus as defined in claim 1, further including:

a plurality of separate pairs of press elements;

said means mounting each pair of press elements comprising a first support for one of the press elements of each pair and a second support for the other press elements of each pair;

means for hingedly connecting the one press elements of each pair at the first support and the other press elements of each pair at the second support; and means for guiding both supports so as to be displaceable in the lengthwise direction of the stacker chute.

5. The apparatus as defined in claim 4, wherein:

said guiding means freely displaceably guides both of said supports in the lengthwise direction of the stacker chute.

6. The apparatus as defined in claim 4, wherein:

said driving means serves to drive said first and second supports;

said driving means comprising a double-acting periodically and alternately fluid operated drive unit.

7. The apparatus as defined in claim 6, wherein:

said driving means includes means for operatively coupling said first and second supports with said drive unit.

8. The apparatus as defined in claim 6, wherein:

said driving means drives the press elements such that the displacement strokes thereof mutually overlap one another;

each of said press elements possesses the shape of a pawl structured so as to be displaceable out of the stacker chute during the course of lifting of such pawls;

stop means provided at the first support effective at the pawls of the second support;

stop means provided at the second support and effective at the pawls of the first support; and each of said stop means at the end of each stroke pushing the momentarily highest situated pawl into the stacker chute.

* * * * *